US009206641B2

(12) United States Patent
Feldstein et al.

(10) Patent No.: US 9,206,641 B2
(45) Date of Patent: Dec. 8, 2015

(54) ADJUSTABLE ROLLER SHADE MOUNTING BRACKET

(71) Applicant: Crestron Electronics, Inc., Rockleigh, NJ (US)

(72) Inventors: George Feldstein, Cresskill, NJ (US); Timothy Wickham, Tappan, NY (US)

(73) Assignee: Crestron Electronics, Inc., Rockleigh, NJ (US)

( * ) Notice: Subject to any disclaimer, the term of this patent is extended or adjusted under 35 U.S.C. 154(b) by 0 days.

(21) Appl. No.: 13/872,571

(22) Filed: Apr. 29, 2013

(65) Prior Publication Data

US 2013/0284383 A1 Oct. 31, 2013

Related U.S. Application Data

(60) Provisional application No. 61/640,095, filed on Apr. 30, 2012.

(51) Int. Cl.
*E06B 9/50* (2006.01)

(52) U.S. Cl.
CPC ..... *E06B 9/50* (2013.01)

(58) Field of Classification Search
USPC ..... 160/242, 323.1, 903; 248/269, 270, 248/271, 272, 257, 258, 259, 260
IPC ..... E06B 9/50
See application file for complete search history.

(56) References Cited

U.S. PATENT DOCUMENTS

| | | | | | |
|---|---|---|---|---|---|
| 1,048,777 | A * | 12/1912 | Wirebaugh | ..... | 248/257 |
| 1,054,131 | A * | 2/1913 | Mealy | ..... | 248/266 |
| 1,374,498 | A * | 4/1921 | Gilbert | ..... | 248/258 |
| 1,397,456 | A * | 11/1921 | Robinson | ..... | 248/270 |
| 1,434,054 | A * | 10/1922 | Heckathorn | ..... | 248/271 |
| 2,331,653 | A * | 10/1943 | Burgess | ..... | 248/271 |
| 2,636,710 | A * | 4/1953 | Reuland | ..... | 248/258 |
| 3,730,469 | A * | 5/1973 | Shields | ..... | 248/265 |
| 7,854,419 | B2 * | 12/2010 | Ng et al. | ..... | 248/269 |
| 8,016,016 | B2 * | 9/2011 | Berman et al. | ..... | 160/242 |
| 8,122,932 | B2 * | 2/2012 | Cannaverde | ..... | 160/120 |
| 8,220,520 | B2 * | 7/2012 | Lukos | ..... | 160/242 |

* cited by examiner

*Primary Examiner* — David Purol
(74) *Attorney, Agent, or Firm* — Crestron Electronics, Inc

(57) ABSTRACT

Presented is a roller shade mounting bracket. The bracket includes a main bracket that includes a top member defining a plurality of elongated openings extending therethrough, where each elongated opening is dimensioned and arranged for receiving a mounting screw and enabling movement along a first axis. The bracket further includes a first sub-bracket movably coupleable to the main bracket, where the first sub-bracket is movable along a second axis. The bracket further includes a second sub-bracket movably coupleable to the first sub-bracket and coupleable to a roller shade motor or a roller shade idler, where the second sub-bracket is movable along a third axis and rotatable about the first axis.

8 Claims, 3 Drawing Sheets

ADJUSTABLE ROLLER SHADE MOUNTING BRACKET

BACKGROUND OF THE INVENTION

1. Technical Field

The present disclosure relates generally to roller shades, and more particularly to a roller shade mounting bracket that is adjustable in four directions.

2. Background

A common problem that occurs when mounting and hanging a roller shade is that the shade mounting brackets, after installation, are misaligned. An obvious consequence of misaligned shade mounting brackets is that the rotational axis of the roller tube is not parallel with the floor. If the roller tube is oriented even slightly off a horizontal rotational axis, impermissible stresses are introduced on the roller tube and/or on the gears of an attached shade motor when the shade motor rotates the roller tube. Further, the shade material does not wind or unwind correctly, which leads to a crooked, wrinkled, and/or damaged shade.

A common solution to fixing misaligned shade mounting brackets is to remount one or both shade mounting brackets in an attempt to align them properly. However, remounting one or both shade mounting brackets requires drilling new mounting screw holes, and spackling or otherwise concealing the incorrectly positioned mounting screw holes.

SUMMARY OF THE INVENTION

It is to be understood that both the general and detailed descriptions that follow are exemplary and explanatory only and are not restrictive of the invention.

In one aspect, the invention involves a roller shade mounting bracket. The roller shade mounting bracket includes a main bracket that includes a top member that defines a plurality of elongated openings extending therethrough, where each elongated opening is dimensioned and arranged for receiving a mounting screw and enabling movement along a first axis. The roller shade mounting bracket further includes a first sub-bracket movably coupleable to the main bracket, where the first sub-bracket is movable along a second axis. The roller shade mounting bracket further includes a second sub-bracket movably coupleable to the first sub-bracket and coupleable to a roller shade motor or a roller shade idler, where the second sub-bracket is movable along a third axis and rotatable about the first axis.

In one embodiment, the main bracket further includes a plurality of guide pins, and the first sub-bracket further includes a top portion defining a plurality of guide holes each dimensioned and arranged for receiving one of the plurality of guide pins.

In another embodiment, the main bracket further includes a threaded pin and the first sub-bracket further includes a first adjustment member defining an opening that is dimensioned and arranged for receiving the threaded pin.

In still another embodiment, the first sub-bracket further includes a lower portion defining a channel, and the top portion of the first sub-bracket further defines a slot.

In yet another embodiment, the second sub-bracket includes a second adjustment member that includes a curved portion and a tab. The channel is dimensioned and arranged for receiving the curved portion and the slot is dimensioned and arranged for receiving the tab.

In another embodiment, the second sub-bracket further includes a locking member and a locking screw, where the locking member moves along the second axis in response to turning the locking screw.

In still another embodiment, when the tab is disposed in the slot and the curved portion is disposed in the channel, the locking member presses against a bottom surface of the top portion of the first sub-bracket when the locking screw is tightened thereby preventing the second sub-bracket from moving along the third axis and rotating about the first axis.

In another aspect, the invention involves a roller shade system. The system includes a roller shade that includes a roller tube, a roller shade motor partially disposed in a first end of the roller tube, a roller shade idler partially disposed in a second end of the roller tube, and two roller shade mounting brackets. Each roller shade mounting bracket includes a main bracket that includes a top member defining a plurality of elongated openings extending therethrough, where each elongated opening is dimensioned and arranged for receiving a mounting screw and enabling movement along a first axis. The mounting bracket further includes a first sub-bracket movably coupleable to the main bracket, where the first sub-bracket is movable along a second axis. The mounting bracket further includes a second sub-bracket movably coupleable to the first sub-bracket and coupled to the roller shade motor or the roller shade idler, where the second sub-bracket is movable along a third axis and rotatable about the first axis.

BRIEF DESCRIPTION OF DRAWINGS

The accompanying figures further illustrate the present invention. Exemplary embodiments are illustrated in reference figures of the drawings. It is intended that the embodiments and figures disclosed herein are to be considered to illustrative rather than limiting.

The components in the drawings are not necessarily drawn to scale, emphasis instead being placed upon clearly illustrating the principles of the present invention. In the drawings, like reference numerals designate corresponding parts throughout the several views.

LIST OF REFERENCE NUMBERS FOR THE MAJOR ELEMENTS IN THE DRAWING

Figure 1:
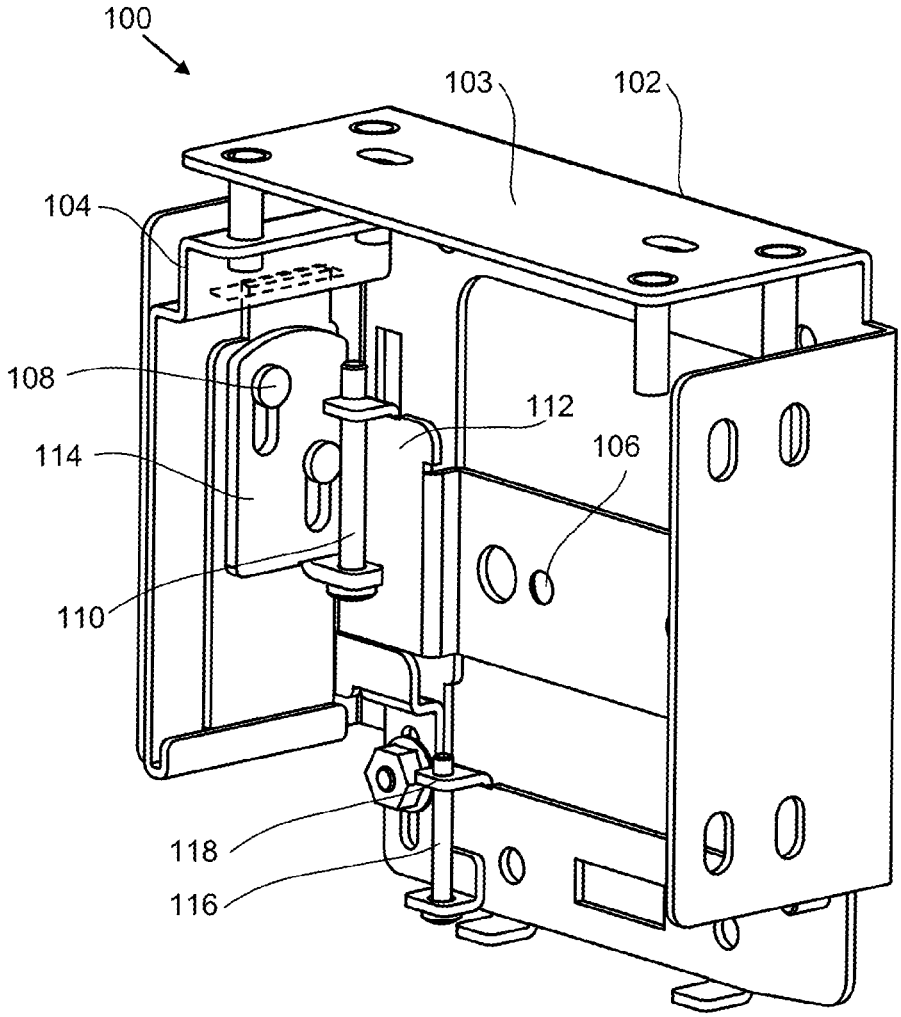
FIG. 1 is an illustrative isometric view of an adjustable roller shade mounting bracket, according to one embodiment of the invention.

The following is a list of the major elements in the drawings in numerical order.

100 roller shade mounting bracket
102 main bracket
103 top member
104 first sub-bracket
106 mounting holes
108 sliding pins
110 locking screw
112 second sub-bracket
114 locking member
116 z-axis adjustment screw
118 z-axis adjustment screw receiving member
202 z-axis adjustment member
203 opening

204 channel
205 upper portion
206 slot
207 lower portion
208 tab
210 curved portion
211 edge surface
212 y-axis adjustment member
213 mounting portion
214 threaded pin
216 locking nut
218 x-axis adjustment holes
220*a* curved arrow
220*b* curved arrow
222 guide pins
224 guide holes
226 inside surface
228 bottom surface
302 roller shade roller tube
304 right roller shade mounting bracket
306 left roller shade mounting bracket
308 roller shade idler
310 roller shade motor
312 right second sub-bracket
314 left second sub-bracket
316 tab
318 tab
320 mounting screws

DETAILED DESCRIPTION OF THE INVENTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

MODE(S) FOR CARRYING OUT THE INVENTION

The present disclosure involves a roller shade mounting bracket. The roller shade mounting bracket is adjustable in four directions (i.e., has four degrees of freedom) to facilitate proper mounting, leveling, and functioning of a roller shade.

Figure 2:
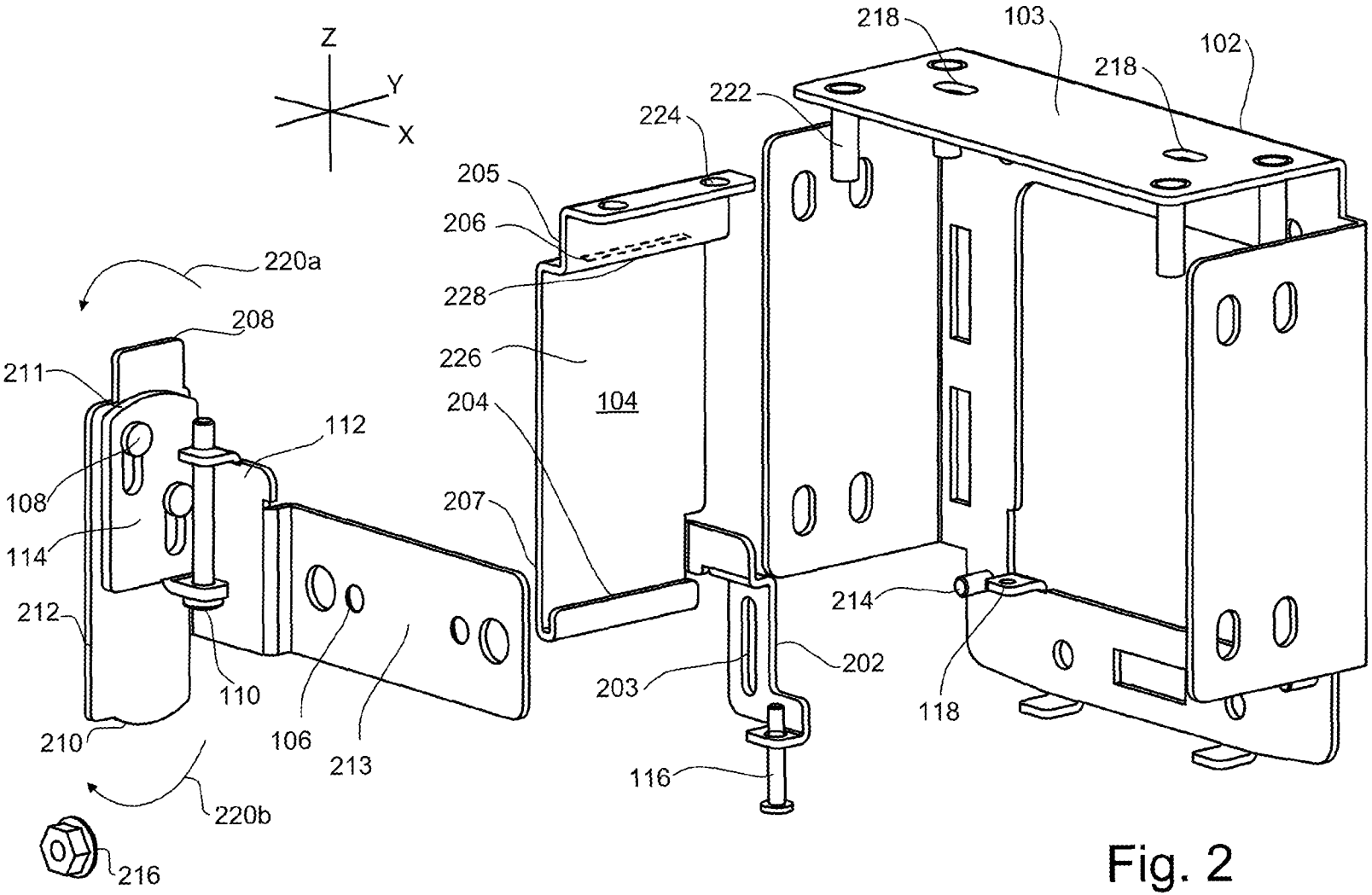
FIG. 2 is an illustrative isometric exploded view of the adjustable roller shade mounting bracket of FIG. 1.

Referring to FIGS. 1 and 2, the roller shade mounting bracket 100 includes a main bracket 102, a first sub-bracket 104, and a second sub-bracket 112.

The main bracket 102 includes threaded pin 214, a top member 103 that defines a plurality of x-axis adjustment holes 218, guide pins 222, locking nut 216, and z-axis adjustment screw receiving member 118.

The first sub-bracket 104 includes an inside surface 226, an upper portion 205 and a lower portion 207. The upper portion 205 defines a plurality of guide holes 224 and a slot 206. The upper portion 205 also includes a bottom surface 228. The lower portion 207 defines a channel 204. The first sub-bracket 104 further includes a z-axis adjustment member 202 that defines elongated opening 203. The first sub-bracket 104 further includes a z-axis adjustment screw 116.

The second sub-bracket 112 includes y-axis adjustment member 212, mounting portion 213, locking member 114, sliding pins 108, and locking screw 110. The y-axis adjustment member 212 includes tab 208 and curved portion 210. The locking member 114 includes edge surface 211 and is held proximate to, and slideable along, the y-axis adjustment member 212 by sliding pins 108. The mounting portion defines a plurality of mounting holes 106.

Still referring to FIGS. 1 and 2, in one embodiment, a pair of roller shade mounting brackets 100, when attached to a roller shade and mounted to a ceiling or inside a window box, enable the position of the roller shade to be adjusted in up to four directions.

In operation, the mounting portion 213 of one sub-bracket 212 is coupled to a roller shade motor via mounting screws disposed through mounting holes 106, and the mounting portion 213 of another sub-bracket 212 is coupled to a roller shade idler via mounting screws disposed through mounting holes 106.

In the first direction, the x-axis adjustment holes 218, which are elongated in a direction along the x-axis (see FIG. 2), are used to adjust the position of entire roller shade mounting bracket 100 (and attached roller shade) along the x-axis. This is accomplished by loosening mounting screws (not shown), moving the entire roller shade mounting bracket 100 to the desired position along the x-axis, and then tightening the mounting screws.

In the second direction, the z-axis adjustment member 202 is used to move an attached roller shade along the z-axis. This is accomplished by first inserting the guide pins 222 into the guide holes 224 and inserting threaded pin 214 though opening 203, and then threading locking nut 216 on threaded pin 214. The z-axis adjustment screw 116 is then screwed into z-axis adjustment screw receiving member 118. As the z-axis adjustment screw 116 is turned clockwise or counter-clockwise, the first sub-bracket 104 moves along the z-axis up or down, respectively. Once the desired position is reached, the locking nut 216 is tightened to prevent further movement of the first sub-bracket 104 along the z-axis.

In the third and fourth directions, second sub-bracket 112 is used to move an attached roller shade along the y-axis and/or rotate an attached roller shade about the x-axis (see arrows 220*a* and 220*b*). This is accomplished by inserting the tab 208 into the slot 206 and inserting the curved portion 210 into the channel 204 and moving the y-axis adjustment member 212 along the y-axis and/or rotating the y-axis adjustment member about the x-axis, as indicated by arrows 220*a* and 220*b*. Once the desired position is reached, the locking screw 110 is turned clockwise to move the locking member 114 until edge surface 211 contacts bottom surface 228 to prevent further movement of the second sub-bracket 112 along the y-axis or about the x-axis In various embodiments, all parts of the roller shade mounting bracket 100 are made of aluminum, stainless steel, plastic, or any combination thereof, or of any other suitable material known to those skilled in the art.

Figure 3:
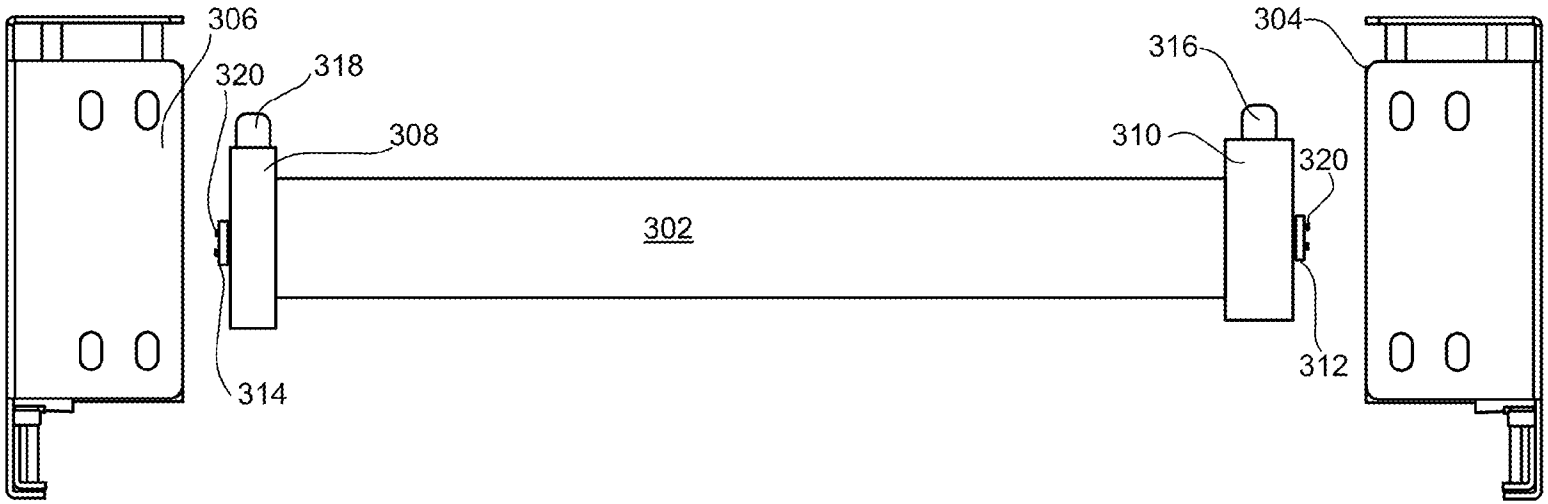
FIG. 3 is an illustrative orthographic front view of a roller shade with adjustable roller shade mounting brackets, according to one embodiment of the invention.

Referring to FIG. 3, in one embodiment, a roller shade with adjustable roller shade mounting brackets is shown. The roller shade includes a roller tube 302, a roller shade idler 308, and a roller shade motor 310. The roller shade idler 308 and the roller shade motor 310 are partially disposed in opposite ends of the roller tube 302. A right second sub-bracket 312 (which includes tab 316) is coupled via mounting screws 320 to the roller shade motor 310 and a left second sub-bracket 314 (which includes tab 318) is coupled via mounting screws

320 to the roller shade idler 308. The right sub-bracket 312 is mounted into a right main bracket 304 and the left sub-bracket 314 is mounted into a left main bracket 306 as described in detail above.

In view of the above-described features, when two such roller shade mounting brackets are disposed on either side of, and coupled to, a roller shade roller tube, the brackets and the roller shade tube are easily aligned with each other, which ensures the proper movement and functioning of the roller shade.

ALTERNATE EMBODIMENTS

Variations, modifications, and other implementations of what is described herein may occur to those of ordinary skill in the art without departing from the spirit and scope of the invention. Accordingly, the invention is not to be defined exclusively by the preceding illustrative description.

What is claimed is:

1. A roller shade mounting bracket, comprising:

a main bracket comprising a plurality of guide pins and a top member defining a plurality of elongated openings extending therethrough, each elongated opening being dimensioned and arranged for receiving a mounting screw and enabling movement along a first axis;

a first sub-bracket comprising a top portion defining a plurality of guide holes each dimensioned and arranged for receiving one of the plurality of guide pins, the first sub-bracket being moveably coupleable to the main bracket and being moveable along a second axis; and a second sub-bracket moveably coupleable to the first sub-bracket and coupleable to a roller shade motor or a roller shade idler, the second sub-bracket being moveable along a third axis and rotatable about the first axis.

2. The roller shade mounting bracket of claim 1, wherein the main bracket further comprises a threaded pin.

3. The roller shade mounting bracket of claim 2, wherein the first sub-bracket further comprises a first adjustment member defining an opening that is dimensioned and arranged for receiving the threaded pin.

4. The roller shade mounting bracket of claim 1, wherein the first sub-bracket further comprises a lower portion defining a channel, and wherein the top portion of the first sub-bracket further defines a slot.

5. The roller shade mounting bracket of claim 4, wherein the second sub-bracket comprises a second adjustment member comprising a curved portion and a tab, and wherein the channel is dimensioned and arranged for receiving the curved portion and the slot is dimensioned and arranged for receiving the tab.

6. The roller shade mounting bracket of claim 5, wherein the second sub-bracket further comprises a locking member and a locking screw, the locking member moving along the second axis in response to turning the locking screw.

7. The roller shade mounting bracket of claim 6, wherein when the tab is disposed in the slot and the curved portion is disposed in the channel, the locking member presses against a bottom surface of the top portion of the first sub-bracket when the locking screw is tightened thereby preventing the second sub-bracket from moving along the third axis and rotating about the first axis.

8. A roller shade system, comprising:

a roller shade comprising a roller tube;

a roller shade motor partially disposed in a first end of the roller tube;

a roller shade idler partially disposed in a second end of the roller tube; and two roller shade mounting brackets, each roller shade mounting bracket comprising:

a main bracket comprising a plurality of guide pins and a top member defining a plurality of elongated openings extending therethrough, each elongated opening being dimensioned and arranged for receiving a mounting screw and enabling movement along a first axis;

a first sub-bracket comprising a top portion defining a plurality of guide holes each dimensioned and arranged for receiving one of the plurality of guide pins, the first sub-bracket being moveably coupleable to the main bracket and being moveable along a second axis; and a second sub-bracket moveably coupleable to the first sub-bracket and coupled to the roller shade motor or the roller shade idler, the second sub-bracket being moveable along a third axis and rotatable about the first axis.

* * * * *